US008366369B2

(12) United States Patent
Toyoizumi et al.

(10) Patent No.: US 8,366,369 B2
(45) Date of Patent: Feb. 5, 2013

(54) SHEET FINISHER AND IMAGE FORMING SYSTEM PROVIDED THEREWITH

(75) Inventors: Teruhiko Toyoizumi, Tachikawa (JP); Tsuyoshi Tsuchiya, Hachioji (JP); Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 387 days.

(21) Appl. No.: 12/798,330

(22) Filed: Apr. 1, 2010

(65) Prior Publication Data

US 2010/0260581 A1 Oct. 14, 2010

(30) Foreign Application Priority Data

Apr. 10, 2009 (JP) ..... 2009-095594

(51) Int. Cl.
*B42C 9/00* (2006.01)
*B42C 13/00* (2006.01)
*B42B 5/00* (2006.01)

(52) U.S. Cl. ..... 412/37; 412/1; 412/6; 412/8; 412/9; 412/13; 412/33; 412/900; 412/901

(58) Field of Classification Search ..... 412/1, 6, 412/8, 9, 13, 33, 37, 900, 901
See application file for complete search history.

(56) References Cited

U.S. PATENT DOCUMENTS 3,973,515 A 8/1976 DeMand
4,310,576 A * 1/1982 Hesselmann et al. ..... 412/8
2003/0215309 A1* 11/2003 Engert et al. ..... 412/33
2005/0238462 A1 10/2005 Oota
2007/0193511 A1 8/2007 Sasamoto et al.
2008/0056850 A1* 3/2008 Matsui et al. ..... 412/37

FOREIGN PATENT DOCUMENTS

EP 1 535 749 A1 6/2005
JP 2005-178187 A 7/2005
JP 2006-347691 A 12/2006
JP 2008-221806 A 9/2008

OTHER PUBLICATIONS

European Search Report dated Nov. 15, 2011 for European Patent Application No. 10 15 9101.

* cited by examiner

*Primary Examiner* — Dana Ross
*Assistant Examiner* — Justin V Lewis
(74) *Attorney, Agent, or Firm* — Holtz, Holtz, Goodman & Chick, PC

(57) ABSTRACT

In a sheet finisher including an adhesive coating section, a movement mechanism, a control section that controls actions of the adhesive coating section and of the movement mechanism, is capable of multiple coating on a spine of a sheet bundle by causing the movement mechanism to move the adhesive coating section reciprocally and relatively with respect to the spine, and is capable of conducting a preparation process to cause the rotary adhesive supplying section to rotate for a prescribed period of time in a rotation direction corresponding to a movement direction of the adhesive coating section under a condition of no coating of the adhesive on the spine of the sheet bundle, after the movement direction of the adhesive coating section and the rotation direction of the rotary adhesive supplying section are switched, following the reciprocating movement in the case of the multiple coating.

11 Claims, 6 Drawing Sheets

SHEET FINISHER AND IMAGE FORMING SYSTEM PROVIDED THEREWITH

This application is based on Japanese Patent Application No. 2009-095594 filed on Apr. 10, 2009, which is incorporated hereinto by reference.

BACKGROUND OF THE INVENTION

The present invention relates to a sheet finisher capable of carrying out case-binding and to an image forming system having therein the sheet finisher and an image forming apparatus.

In the sheet finisher for carrying out case-binding, a cover sheet is cased up for bookbinding, after adhesives are coated on a spine of bundled sheets. An example of an outline of this process will be explained as follows, referring to FIG. 6.

In the process of the case-binding, sheets P supplied from an image forming apparatus and others are stacked on stopper 100 to be aligned. After sheets P in a prescribed quantity are stacked, they are pressed by pressing members 101 from both sides of the sheets in the direction of a thickness of the sheets to be interposed, and the sheets are kept as sheet bundle 110. The stopper 100 is caused to retreat from its location. Adhesives 111 are coated on a spine of this sheet bundle 110, and elevating plate 103 carrying thereon cover sheet 112 is raised toward the spine or lowered. Meanwhile, on the elevating plate 103, there are positioned spine corner forming plates 104 and 104 which form a spine corner on the spine side of the sheet bundle, on both sides of the sheet bundle 110, and spine corner forming plates 104 and 104 are capable of moving in the direction of a thickness of the sheets.

When the elevating plate 103 is raised and the cover sheet 112 is pressed against the spine, the sheet bundle 110 and the cover sheet 112 are bonded together by the adhesives 111. Then, the spine corner forming plates 104 and 104 are moved to the inside from both sides of the sheet bundle 110 to form a spine corner on the cover sheet 112, thus, booklet 115 is obtained.

With respect to coating of adhesives on the aforesaid sheet bundle, adhesives are usually coated in a way wherein a unit including an adhesive coating roller that rotates is moved against a sheet bundle, and the aforesaid roller is caused to touch the spine of the sheet bundle. A part of the aforesaid adhesive coating roller is caused to touch adhesives in an adhesive storing section that stores adhesives, and when the roller rotates, the adhesives are taken out to be supplied.

There is further proposed an apparatus wherein double coating is made possible by coating adhesives in an outward trip and in a return trip, for the thick coating of adhesives on the spine of the sheet bundle for the purpose of an increase of adhesion strength (for example, see Unexamined Japanese Patent Application Publication No. 2005-178187).

Incidentally, if the adhesive coating roller is rotated in the same direction both for the outward trip and the return trip, uneven and non-uniform coating is caused though a coating weight is increased, in the case of the reverse rotation of the adhesive coating roller (counter coating), although the coated surface is excellent when the direction of the rotation of the roller is a forward direction (regular direction coating).

When a booklet is thin, the aforesaid influence is not very conspicuous, but, when a thickness of a booklet grows greater, an air layer is formed on an uneven portion, thereby, positions which lack adhesion partially are generated, which lowers adhesion strength. Therefore, even in the case of the apparatus disclosed in Unexamined Japanese Patent Application Publication No. 2005-178187,it is possible to conduct coating under the condition of regular rotation (regular direction coating) at all times by switching also the rotation direction of the adhesive coating roller when switching the direction of movement of the adhesive coating roller in the case of the second coating.

However, if the direction of rotation of the adhesive coating roller is switched, an adhesive film on the adhesive coating roller is disturbed for some time immediately after the switching of the rotation direction. Thus, if coating is started without taking any actions, the adhesion quality in the period of start coating is lowered and adhesion strength is lowered, which is a problem.

The invention has been achieved in the context of the aforesaid circumstances, and its object is to provide a sheet finisher capable of obtaining excellent coating conditions even in the case of switching the rotation direction so that the adhesive coating roller may constantly be in the state of regular rotation for the direction of movement, when conducting multiple coating on the spine of the sheet bundle, and to provide an image forming system.

SUMMARY OF THE INVENTION (1) To achieve the abovementioned object, a sheet finisher reflecting one aspect of the present invention comprises an adhesive coating section that coats adhesives on a spine of a sheet bundle, a movement mechanism that moves the adhesive coating section relatively to the spine of the sheet bundle in the longitudinal direction of the spine of the sheet bundle and a control section that controls actions of the adhesive coating section and of the movement mechanism and the adhesive coating section is equipped with an adhesive storing section that stores adhesives and with a rotary adhesive supplying section that takes out adhesives from the adhesive storing section by rotating while touching adhesives stored in the adhesive storing section, to be ready for the coating of adhesives, while, the control section is characterized to make multiple coating on the spine of the sheet bundle to be possible by causing the movement mechanism to move the adhesive coating section reciprocally and relatively, and to be capable of conducting a preparation process to cause the rotary adhesive supplying section to rotate for a prescribed period of time in the direction of rotation corresponding to the direction of movement of the adhesive coating section after the aforesaid switching under the condition of no coating of adhesives on the spine of the sheet bundle, in the case of the switching of the rotation direction, when the direction of movement of the adhesive coating section and the rotation direction of the rotary adhesive supplying section are switched, following the aforesaid reciprocating movement, in the case of multiple coating.

(2) In the sheet finisher of the item (1), it is preferable that the control section stops the aforesaid movement of the adhesive coating section during the preparation process.

(3) In the sheet finisher of the item (1) or (2), it is preferable that the control section causes the rotation speed of the aforesaid rotary adhesive supplying section in the preparation process to be higher than the rotation speed in the aforesaid coating.

(4) In the sheet finisher described in any one of the items (1)-(3), it is preferable that the control section causes the speed of movement to be lower than the speed of movement in the course of the aforesaid coating, in the case of moving the adhesive coating section in the preparation process.

(5) In the sheet finisher described in any one of the items (1)-(4), it is preferable that the control section causes the rotary adhesive supplying section to make at least one turn in the course of the preparation process.

(6) In the sheet finisher described in any one of the items (1)-(5), it is preferable that the control section can select whether to conduct practice of the preparation process or not, in the case of switching the direction of movement of the adhesive coating section.

(7) In the sheet finisher in the item (6), it is preferable that the control section can select whether to conduct practice of the preparation process or not, in accordance of a sheet type or a sheet thickness in sheets of the sheet bundle.

(8) In the sheet finisher described in any one of the items (1)-(7), it is preferable that the control section can select the direction of rotation of the rotary adhesive supplying section, corresponding to the direction of movement of the adhesive coating section, in the case of reciprocating movement of the adhesive coating section.

(9) In the sheet finisher described in any one of the items (1)-(8), it is preferable that an operation section that can be used by an operator for setting input is provided.

(10) An image forming system having therein an image forming apparatus equipped with an image forming section that forms an image on a sheet and a sheet finisher described in any one of the aforesaid items (1)-(9), wherein, it is preferable that a control section that controls actions of the adhesive coating section and the movement mechanism of the sheet finisher is installed in any one of a sheet finisher main body and an image forming apparatus main body.

(11) In the image forming system of the item (10), it is preferable that an operation section capable of inputting establishment of the sheet finisher by an operator is provided on the image forming apparatus main body.

Each of FIGS. 2A-2D is a diagram showing a coating process for first coating of an embodiment of the invention.

Figure 3E:
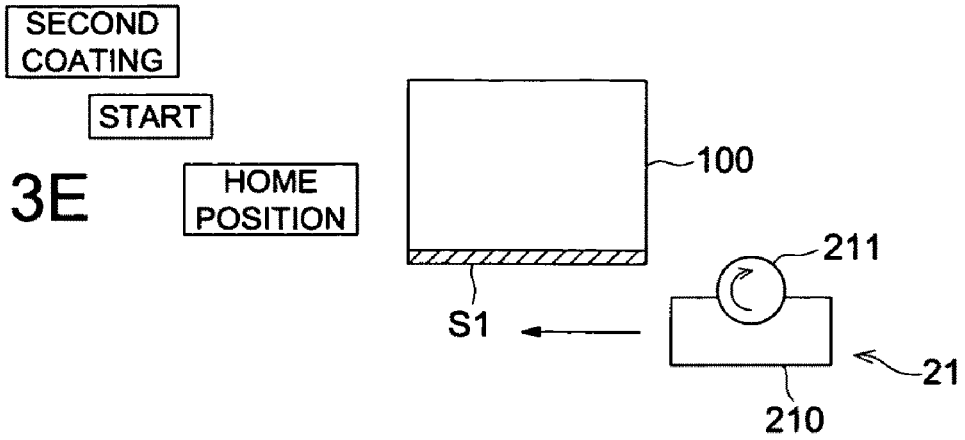
Figure 3F:
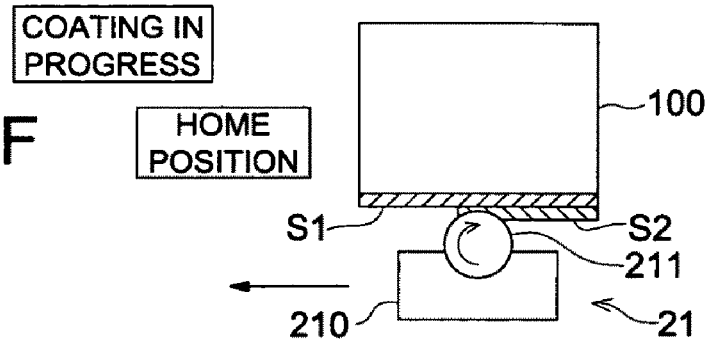
Figure 3G:
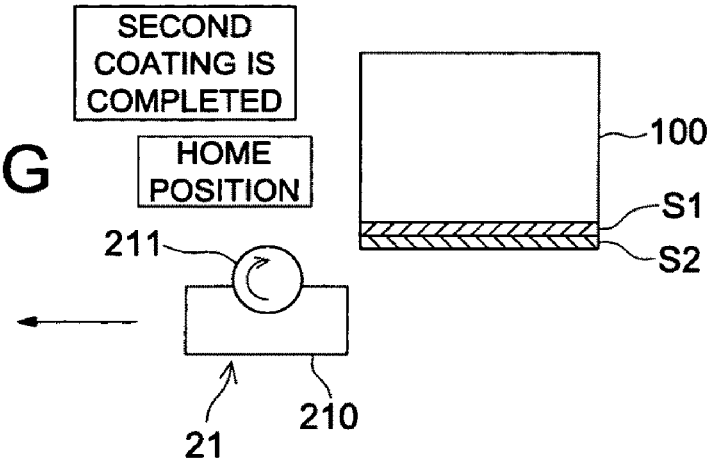

Each of FIGS. 3E-3G is a diagram showing a coating process for second coating of an embodiment of the invention.

Figure 4:
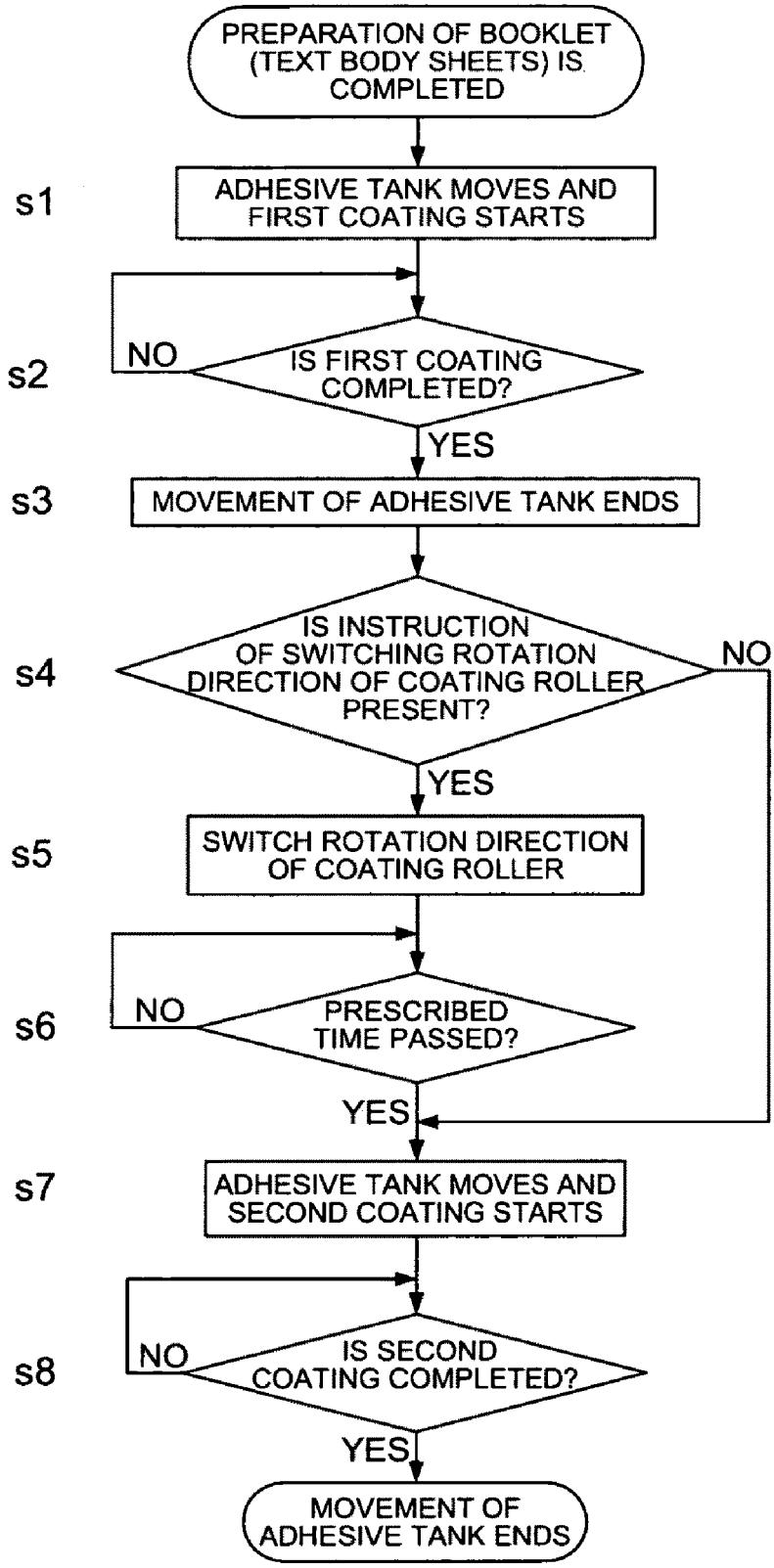

FIG. 4 is a flow chart showing procedures of a coating process of an embodiment of the invention.

Figure 5A:
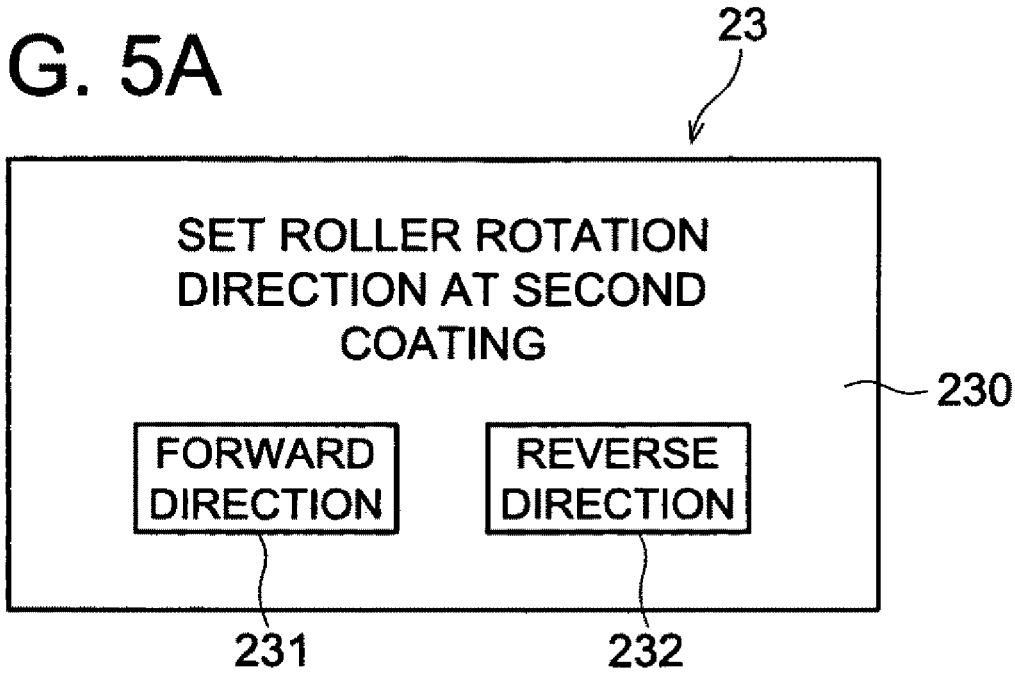
Figure 5B:
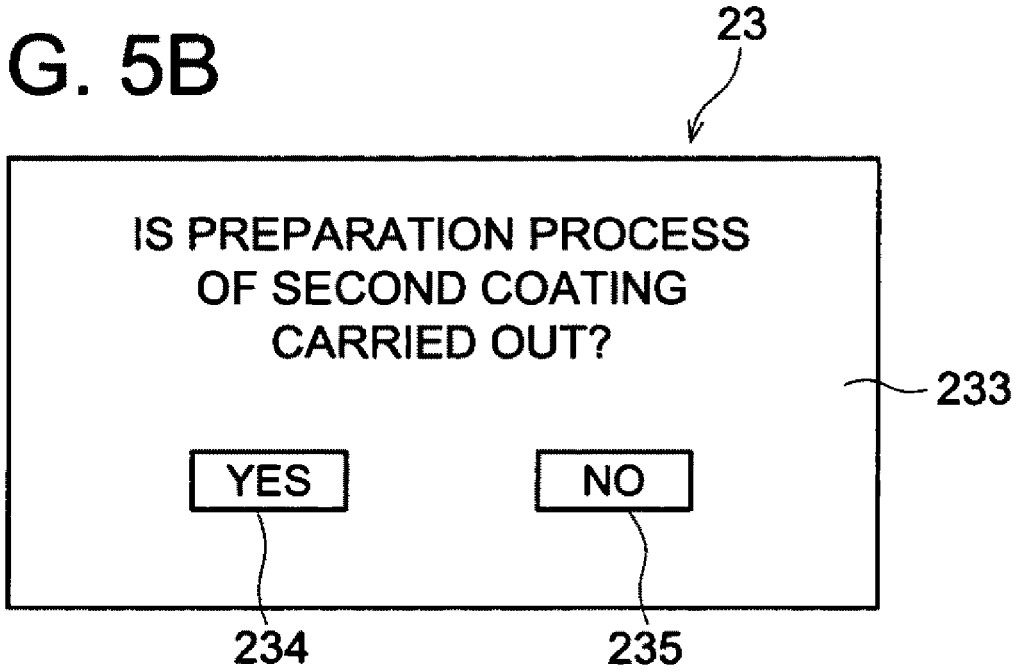

Each of FIGS. 5A and 5B is a diagram showing an example of an image area of an operation and display section of an embodiment of the invention.

Figure 6:
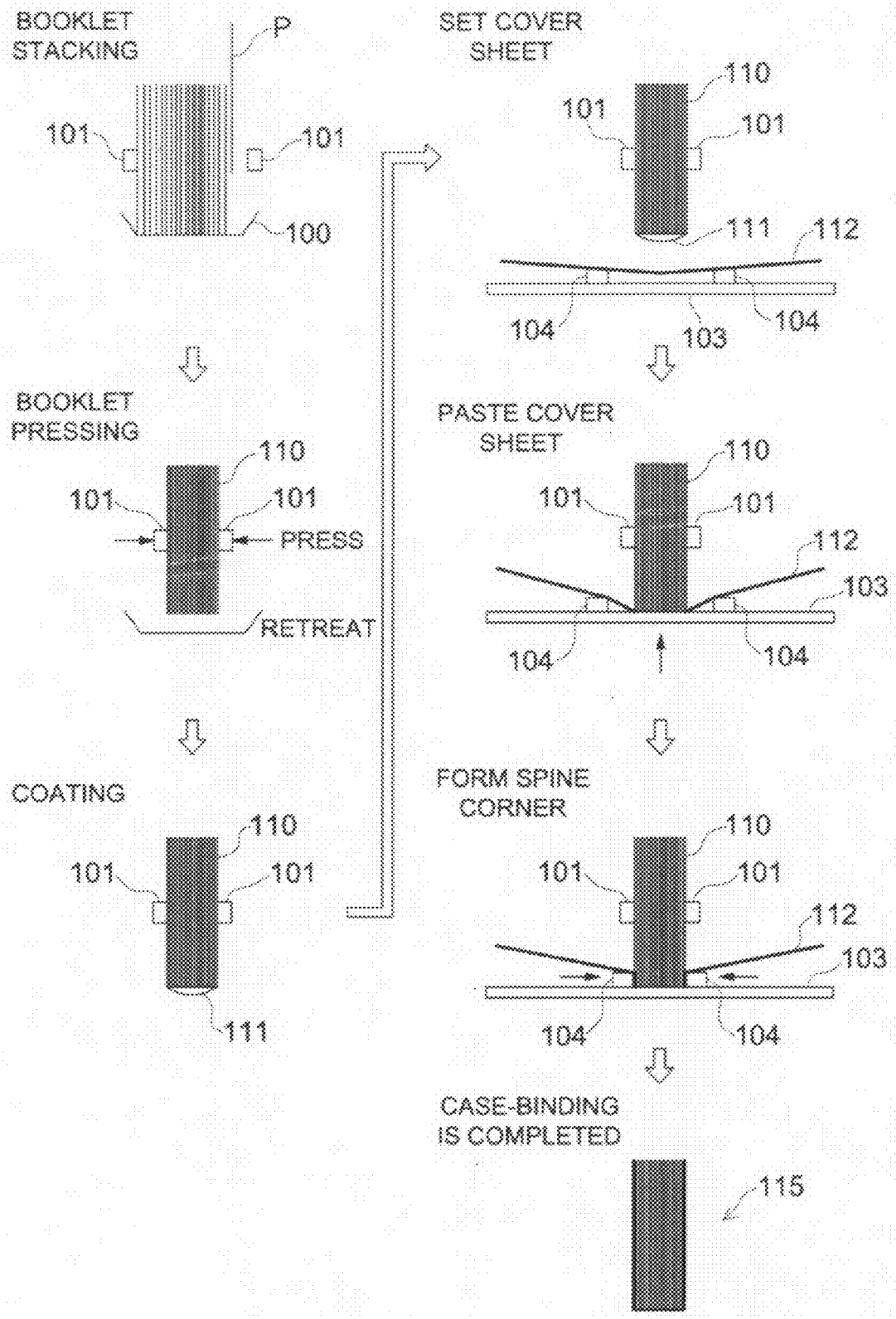

FIG. 6 is a diagram showing a bookbinding process.

DETAILED DESCRIPTION OF THE PREFERRED EMBODIMENT

An embodiment of the invention will be explained as follows, referring to the attached drawings. Incidentally, since processes from stacking of sheet bundles to bookbinding are the same as those explained based on FIG. 6, its detailed explanation will be omitted in the present embodiment.

Figure 1:
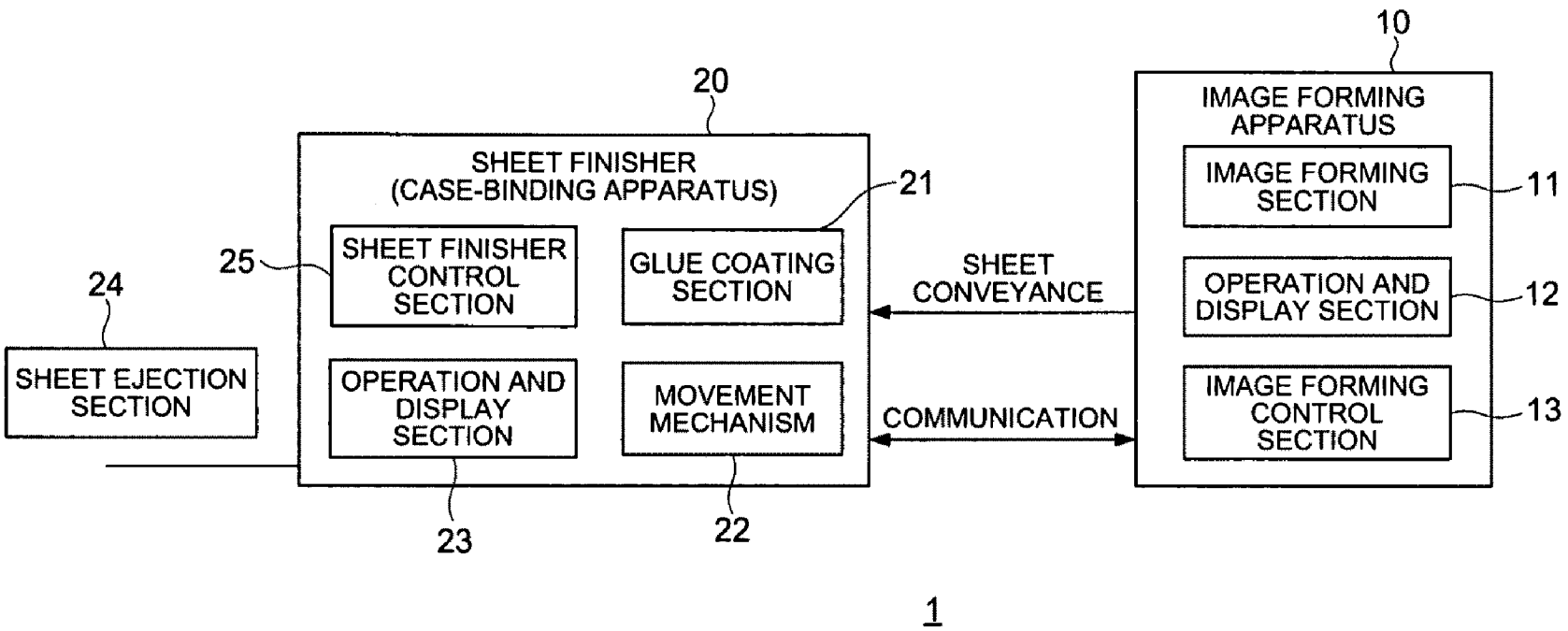
FIG. 1 is a schematic block diagram of an embodiment of the invention.

FIG. 1 is a schematic and functional block diagram of image forming apparatus 1, and it is composed of image forming apparatus 10 and sheet finisher 20. The image forming apparatus 10 and the sheet finisher 20 are connected mechanically so that a sheet ejected from the image forming apparatus 10 may be conveyed to the sheet finisher 20, and the image forming apparatus 10 and the sheet finisher 20 are connected to be capable of communicating each other so that information may be delivered and received.

The image forming apparatus 10 has, in its image forming apparatus main body, image forming section 11 that conducts image forming on a sheet, and the image forming section 11 is composed of an unillustrated photoconductor, a charging section, a writing section, a developing section, a transfer section and of a fixing section.

Further, the image forming apparatus 10 has, on its image forming apparatus main body, operation and display section 12 that is composed of a touch panel or the like and is used by an operator for inputting of operations, and various types of information can be displayed on the operation and display section 12.

On the image forming apparatus 10, there is provided image forming control section 13 controlling the overall image forming apparatus in the image forming apparatus main body, and the image forming section 11 is connected to be capable of being controlled, so that image forming are controlled. Further, to the image forming control section 13, there is connected the operation and display section 12 to be capable of being controlled so that appropriate information may be displayed, and it is made up so that an input of operation by an operator is possible, and input information may be transmitted to the image forming control section 13. In the image forming control section 13, appropriate processing is conducted based on the inputted information.

The image forming control section 13 is mainly composed of CPU and of a program that causes CPU to act, and it is further equipped with a storage section represented by a flash memory in which ROM storing the aforesaid program, RAM serving as a work area, action parameters and setup data are stored.

The sheet finisher 20 has, in its sheet finisher main body, adhesive coating section 21 that conducts adhesive coating on a sheet conveyed from image forming apparatus 10, and it is further equipped with a stacking section (unillustrated) that stacks sheets to be coated by the adhesive coating section 21 into sheet bundles. Further, the sheet finisher main body is equipped therein with movement mechanism 22 that can move the adhesive coating section 21 reciprocally along the longitudinal direction of the spine of the sheet bundle for the stacked sheet bundles. The movement mechanism 22 moves the adhesive coating section 21 reciprocally with a motor (unillustrated) serving as a driving source. Incidentally, the movement mechanism 22 is one to move the adhesive coating section 21 relatively for sheet bundles, and it may also be one to move a sheet bundle in place of moving the adhesive coating section 21, and it is further possible to move both of them.

The sheet finisher 20 is composed of a sheet finisher main body and of a touch panel, and on the sheet finisher 20, there is provided operation and display section 23 which can be used by an operator to input operation and further can display various types of information.

Further, the sheet finisher 20 is equipped with sheet ejection section 24 that ejects a case-bound booklet from the sheet finisher main body.

In the sheet finisher main body of the sheet finisher 20, there is provided sheet finisher control section 25 that corresponds to the control section in the invention and controls the sheet finisher 20 totally. Adhesive coating section 21 and movement mechanism 22 are connected to the sheet finisher control section 25 to be capable of controlling, thus, adhesive coating is controlled. Further, operation and display section 23 is connected to the sheet finisher control section 25 to be capable of controlling, thus, suitable information can be displayed, and in addition, operation input by an operator is possible so that input information can be transmitted to the sheet finisher control section 25 in the constitution. In the sheet finisher control section 25, suitable processing is carried out based on the input information. The sheet finisher control section 25 is mainly composed of CPU and of a program that causes CPU to act, and it is further equipped with a storage section represented by a flash memory in which ROM storing the aforesaid program, RAM serving as a work area, action parameters and setup data are stored.

The adhesive coating section 21 corresponds to the adhesive storing section of the invention as is shown in FIGS. 2A-2D, and has adhesive storing tank 210 that stores adhesives and adhesive coating roller 211 that corresponds to the rotary adhesive supply section of the invention. The adhesive coating section 21 is further equipped with a driving device (unillustrated) that can drive the adhesive coating roller 211 to rotate in the forward direction and the reverse direction and with a heating device (unillustrated) that heats adhesives in the adhesive storing tank 210. It is further possible to provide a device that heats the adhesive coating roller 211.

Meanwhile, with respect to the aforesaid rotary adhesive supply section, the one wherein adhesives are supplied through rotation of a roller and a belt is commonly used. However, the invention is not limited to this, and the invention has only to be an object that can take adhesives out of the adhesive storing section through rotation. The rotary adhesive supply section may either be a coating roller that coats adhesives on a sheet bundle directly, or be one that coats adhesives on a sheet bundle through other members (those rotating or those fixed).

Incidentally, in the present description, materials coated on a sheet bundle to bond a cover sheet with the sheet bundle are called adhesives, and it has only to be one that can bond a sheet bundle with a cover sheet, and its quality of the material is not limited in particular as the present invention, thereby, those called bonding agents are also included.

Next, operations of the aforesaid image forming system will be explained as follows.

In the image forming apparatus 10, a job is started when a job starting button of operation and display section 12 is pressed by an operator. After the job is started, image forming section 11 is controlled by image forming control section 13, and a latent image is formed on the photoconductor by a writing section based on image data, after the photoconductor included in the image forming section 11 is charged evenly by a charging section. The latent image is developed by a developing section into a toner image which is transferred by a transfer section onto a sheet fed from an unillustrated sheet-feeding section. The transferred image is conveyed to a fixing section to be fixed through heating, and is further conveyed to the sheet finisher 20, in accordance with sheet finishing setup.

In the sheet finisher 20, a sheet on which an image is formed through control of sheet finisher control section 25 is stacked to be held as a sheet bundle, and the spine of the sheet bundle is coated with adhesives. In the sheet finisher control section 25, a coating process for adhesives is controlled in accordance with contents of setting for adhesive coating. Namely, in the, sheet finisher 20, it is possible to select single coating or double coating for adhesive coating, and in the sheet finisher control section 25, single coating or double coating is selected in accordance with setting.

Further, in the sheet finisher 20, when double coating is selected, it is possible to select between the case to make the adhesive coating section to move reciprocally and to make the adhesive coating roller 211 to rotate in the fixed direction and the case to switch the rotation direction of the adhesive coating roller following switching of the movement of the adhesive coating section, and in the sheet finisher control section 25, it is selected whether to switch the rotation of adhesive coating roller 211 in accordance with setting or not to switch.

Further, in the sheet finisher 20, when switching the rotation direction of the adhesive coating roller following switching of the movement of the adhesive coating section in the second coating, it is possible to select whether to conduct a preparation process of the invention or not, and in the sheet finisher control section 25, it is selected whether to carry out the preparation process in accordance with setting or not.

The selections mentioned above are made by the sheet finisher control section 25 based on established information. The establishment can be carried out by setting input by the operation and display section 23. An example of this is shown in FIGS. 5A and 5B.

FIG. 5A shows setting screen 230 to decide a rotation direction of the adhesive coating roller for the forward direction or the reverse direction when switching the movement of the adhesive coating section, in the case of double coating. In the setting screen 230, forward direction button 231 and reverse direction button 232 are displayed to be capable of being pressed, and it is possible to set the rotation direction of the adhesive coating roller 211 by pressing either one of the aforesaid buttons. If the forward direction button 231 is pressed, the rotation direction of the adhesive coating roller 211 is also switched following switching of the movement of the adhesive coating section 21, and the adhesive coating roller 211 rotates in the forward direction constantly for the direction of movement. On the other hand, if the reverse direction button 232 is selected, the rotation direction of the adhesive coating roller 211 is caused to remain unchanged, in spite of switching of the movement of the adhesive coating section 21. Therefore, the adhesive coating roller 211 rotates in the forward direction when the adhesive coating section 21 moves through an outward trip, while, the adhesive coating roller 211 rotates in the reverse direction when the adhesive coating section 21 moves through a returning trip.

FIG. 5B shows setting screen 233 to decide whether to provide a preparation process or not, when switching the rotation direction for the adhesive coating roller following switching of the movement of the adhesive coating section in the case of double coating. In this setting screen 233, there are displayed "Yes" button 234 for conducting a preparation process and "No" button 235 for omitting a preparation process. When the "Yes" button 234 is pressed, in the case of switching the rotation direction of the adhesive coating roller 211 following the switching of the direction of the movement of the adhesive coating section 21, the adhesive coating roller 211 is caused to rotate for a prescribed period of time in the rotation direction after the switching, so that an adhesive film is stabilized. On the other hand, when the "No" button 235 is pressed, in the case of switching the rotation direction of the adhesive coating roller 211 following the switching of the direction of the movement of the adhesive coating section 21, the direction of movement of the adhesive coating section 21 and the direction of rotation of the adhesive coating roller 211 are switched to conduct second adhesive coating, without stabilizing the adhesive film by causing the adhesive coating roller 211 to rotate for a prescribed period of time.

It is possible to make the aforesaid selection by causing the aforesaid setting to be stored in the storing section included in the sheet finisher control section 25, and by reading out the setting suitably. The setting may either be one conducted by setting input of the operation and display section 23 as stated above or one which is set in advance. Further, the setting may be made to be one that can be changed on the operation and display section 23 each time or suitably. It is further possible to make the aforesaid selection by setting the selection for a sheet type or a sheet thickness, and by selecting based on the information of the sheet to be coated with adhesives. The sheet type and the sheet thickness are controlled by image forming control section 13 of the image forming apparatus, and when these data are transmitted to sheet finisher control section 25 from the image forming control section 13, the information can be obtained. The sheet finisher control section 25 obtains these data to make the aforesaid selections in accordance with the setting.

Incidentally, as the present invention, any one of the aforesaid selections may be impossible, and the essential point is one wherein the preparation process can be carried out in the case of switching the rotation direction of the adhesive coating roller following the switching of the movement of the adhesive coating section in the second coating.

A sheet to become a cover sheet is conveyed from an unillustrated cover sheet supplying device to the sheet bundle on which adhesives have been coated in the aforesaid manner to make contact with the surface with adhesives, to be pasted for bookbinding. In this case, the sheet to become a cover sheet may also be one to be pasted after being cut to be in a suitable size, and it is also possible to form a spine corner for bookbinding. A booklet thus obtained is ejected to sheet ejection section 24.

Next, operations to carry out double coating in the aforesaid adhesive coating process will be explained as follows, referring to process flow diagrams of FIGS. 2A-2D and FIGS. 3E-3G and to a flow chart in FIG. 4.

Figure 2A:
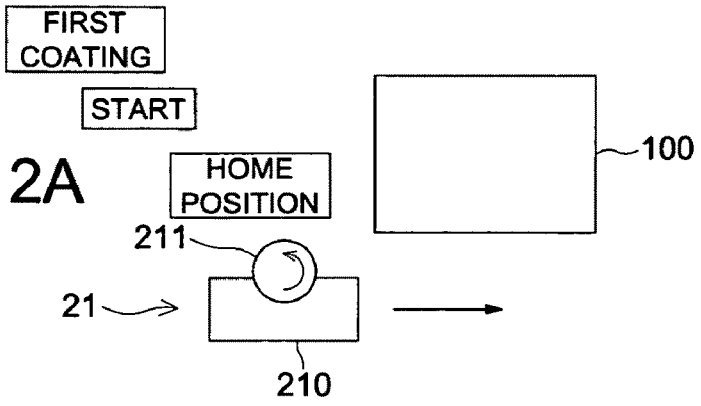

When preparations of a sheet bundle are completed, the sheet finisher control section 25 causes adhesive storing tank 210 to move to start first coating (step s1). Specifically, adhesive coating section 21 is moved by an unillustrated driving device in movement mechanism 22 in the direction that is in parallel with a longitudinal direction on the bottom surface of sheet bundle 100, to be placed at an initial position (FIG. 2A). Under this state, adhesives in the adhesive storing tank 210 are ready to be coated after being heated by a heating device.

Figure 2B:
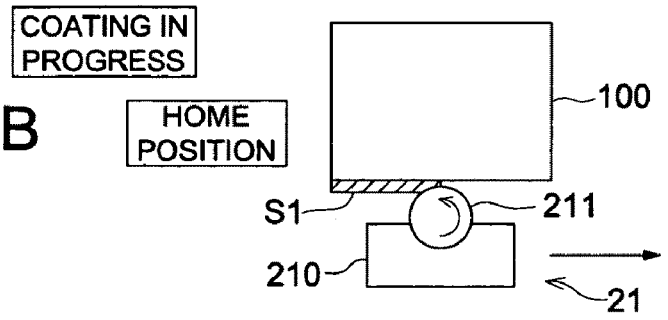
Figure 2C:
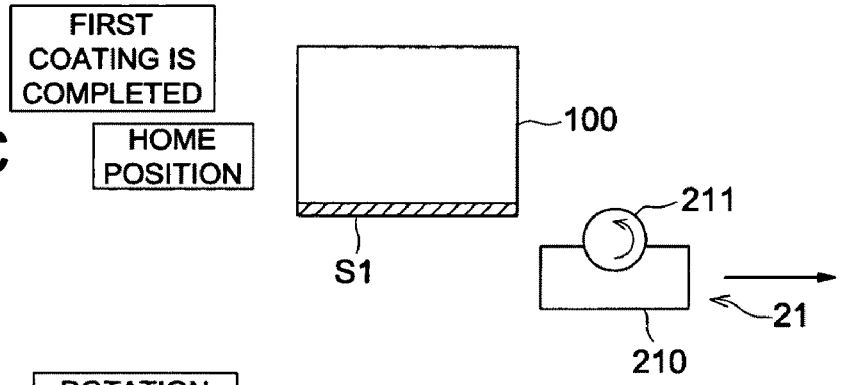

Adhesive coating roller 211 is rotated by an unillustrated driving device so that the adhesive coating roller 211 may be in the forward direction for the intended direction for movement. Under the condition of this state, adhesive coating section 21 starts moving from the initial position in the longitudinal direction on the spine of sheet bundle 100 through movement mechanism 22. Owing to this, adhesives taken out of the adhesive storing tank 210 in order by the adhesive coating roller 211 form an adhesive film on the surface of the adhesive coating roller 211 and come in contact with the spine of the sheet bundle 100 to coat adhesive S1 of the first layer on the spine (FIG. 2B). The adhesive coating section 21 is moved by the movement mechanism 22 to the prescribed position surpassing a length of the sheet bundle to complete first coating (FIG. 2C, step s2).

Figure 2D:
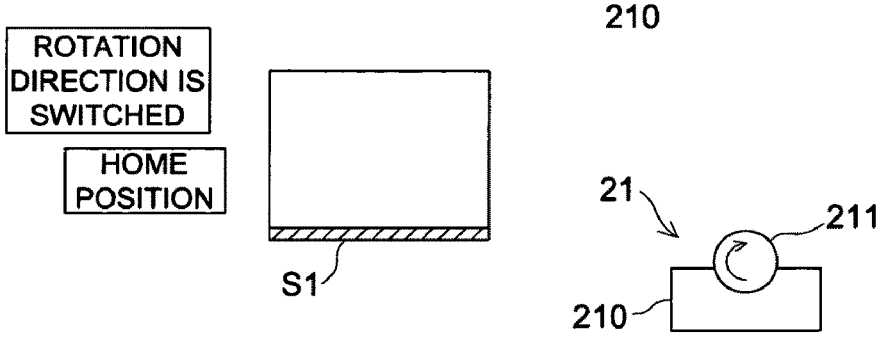

The adhesive coating section 21 that has arrived at the prescribed position stops its movement at that position (step s3). In this case, in the sheet finisher control section 25, it is judged whether a setting for switching of the rotation direction of the adhesive coating roller 211 has been made following switching of the movement of the adhesive coating section 21 or not (step s4). Meanwhile, with respect to the aforesaid setting, when the setting is conducted based on a sheet type or a sheet thickness, information of a sheet type or of a sheet thickness is acquired from image forming control section 13 of image forming apparatus 10, then, setting data are read out of a storage section based on the sheet type or the sheet thickness, and the aforesaid selection is made based on the setting data. When setting for switching of the rotation direction is not carried out (step s4, NO), the second coating is conducted while the rotation direction of the adhesive coating roller 211 remains unchanged (to step s7). On the other hand, when setting for switching of the rotation direction of the adhesive coating roller 211 has been carried out (step s4, YES), the rotation direction of the adhesive coating roller 211 is switched to be opposite to the aforesaid direction so that the forward direction may be obtained for the movement of a return trip for the adhesive coating section 21 (FIG. 2D, step s5). Immediately after switching the rotation to the opposite direction, an adhesive film on the roller surface is in the disturbed state, because the direction for taking out adhesives from the adhesive storing tank 210 is also switched. This rotation is continued for the prescribed period of time, such as 1 second or more preferably, or a period of time during which adhesive coating roller 211 makes one turn or more, to carry out the preparation process (step s6). The prescribed period of time is stored in the storage section of the sheet finisher control section 25, and it is read out as occasion demands. Incidentally, the prescribed period of time may also be one wherein time periods which are different based on a sheet type and a sheet thickness are set. In the course of this preparation process, an adhesive film on the adhesive coating roller 211 becomes to be uniform and stable. After that, the movement mechanism 22 causes the adhesive coating section 21 to move in the direction toward its return trip while the adhesive coating roller 211 is rotating in the forward direction (FIG. 3E). Even in this case, adhesives which are taken out of the adhesive storing tank 210 by the adhesive coating roller 211 form, on the roller surface, an adhesive film which comes in contact with the spine of sheet bundle 100 to coat adhesive S2 for the second layer on the spine (FIG. 3F, step s7). When the adhesive coating section 21 returns to its initial position, the second coating is completed (FIG. 3G, step s8), and the adhesive coating section 21 moves to a stand-by position.

By conducting double coating by providing the aforesaid preparation process, adhesives can be coated on the spine of the sheet bundle uniformly and excellently to be free from unevenness, and excellent adhesion strength can be obtained even in the case where a thickness of the sheet bundle is thick.

Meanwhile, in the aforesaid embodiment, control of the adhesive coating process in the sheet finisher is conducted in the sheet finisher control section. However, as the present invention, it is also possible to control in the image forming control section provided on the image forming apparatus. Further, the setting in the sheet finisher has been explained to be conducted on the operation and display section. However, in the invention, it is also possible to conduct setting on the operation and display section equipped on the image forming apparatus.

As stated above, the present invention has been explained based on the embodiment of the invention, and the invention is not limited to contents of the aforesaid embodiment, and it can be varied without departing from the spirit and scope of the invention.

In the present embodiment, when switching the rotation direction of the rotary adhesive supplying section in the case of switching the direction of movement of the adhesive coating section, the coating under the condition of switched direction of movement of the adhesive coating section becomes possible after the rotary adhesive supplying section is rotated in the switched direction for the prescribed period of time. Therefore, it is possible to start coating under the condition wherein an adhesive film of the rotary adhesive supplying section is stabilized, thus, it is possible to obtain an excellent state of coating without unevenness on a coated surface on a sheet bundle.

When switching the rotation direction of the aforesaid rotary adhesive supplying section together with the direction of movement of the adhesive coating section following the reciprocating movement of the adhesive coating section, it is possible to stabilize an adhesive film of the rotary adhesive supplying section, and to coat adhesives on a sheet bundle properly including the start of coating. Therefore, there are effects to secure bookbinding adhesion strength by coating adhesives to be thick, and to upgrade the state of coating.

In the aforesaid preparation process, it is either possible to stop the movement of the adhesive coating section and to rotate the rotary adhesive supplying section while the adhesive coating section is stopped, or possible to rotate the rotary adhesive supplying section while moving the adhesive coating section. In addition, it is further possible to combine these two cases. However, it is preferable to carry out rotations for the preparation process under the condition that the adhesive coating section is stopped, for making the adhesive film to be in the more stable state.

With respect to rotations of the rotary adhesive supplying section in the preparation process, a period of time for the rotations is set so that the adhesive film may be in the stable state. However, the invention is not limited to the specific period of time, except that security of at least a period of time for the rotary adhesive supplying section to make one turn is preferable.

Further, with respect to rotations of the rotary adhesive supplying section in the preparation process, the rotations can be carried out at a rotation speed that is different from the rotation speed for the coating, thus, it is possible to shorten the time required for the preparation process by conducting it at higher speed. Further, when rotating the rotary adhesive supplying section at a higher speed in the preparation process, it is also possible to lower gradually the rotation speed in the last phase of the preparation process to make it to be equal to the rotation speed in the case of coating adhesives. Owing to this, the adhesive film can be made to be in the state that is more stable.

Further, in a construction wherein a rotary adhesive supplying section is moved toward a sheet bundle after its direction of movement is reversed after it is moved to the prescribed position beyond the sheet bundle, when switching the direction of movement of the rotary adhesive supplying section, it is possible to lower the speed of movement in a part or the whole of the reciprocating movement exceeding the sheet bundle, to secure the preparation process in the case of this movement. Due to this, a period of time for the preparation process can be secured without stopping the adhesive coating section. Incidentally, it is also possible to make rotations for the preparation process to be one wherein rotations in the case of discontinuation are added to rotations in the case of movement.

Further, when switching the direction of rotation of the rotary adhesive supplying section, following the switching of the movement of the adhesive coating section, it is also possible to carry out the aforesaid preparation process surely, and it is also possible to arrange so that it is possible to select practicing of the preparation process or not through setting. The selection is conducted by the control section based on setting information. The aforesaid setting may either be one that is determined by setting operations by an operator, or be one wherein information established in advance is made by operations of an operator to be one that is changeable by operation. Further, it may also be one wherein presence or absence of practicing of the preparation process is selected based on a sheet type or a sheet thickness of the sheet bundle. For example, when an influence of the state of coating on adhesion strength is small based on a sheet type and a sheet thickness, a preparation process can be omitted. Further, through the setting, it is possible to select to omit the preparation process when taking a serious view of productivity and to practice the preparation process when taking a serious view of the state of coating.

Though the aforesaid preparation process is on the assumption that the rotation direction of the rotary adhesive supplying section is switched following the switching of the movement of the adhesive coating section, adhesive coating can be made possible by maintaining the same direction without switching the rotation direction of the rotary adhesive supplying section even in the case of switching the movement of the adhesive coating section, in the sheet finisher of the invention. It is possible to make it selectable through setting whether to switch the rotation direction of the rotary adhesive supplying section following the switching of the movement of the adhesive coating section or not. The selection is made by the control section based on information of setting. Even in the case of multiple coating, different states of coating can be obtained by selection.

The setting input by an operator can be carried out through an operation section equipped on the apparatus. The operation section can be composed of an operation and display section that serves also as a display section, and it may also be one that is provided separately from the display section. As the operation and display section, a touch panel or the like can be exemplified.

The aforesaid sheet finisher can constitute an image forming apparatus together with an image forming apparatus main body that is equipped with an image forming section. A control section that controls operations of the adhesive coating section of the sheet finisher and of a movement mechanism may either be one installed on a sheet finisher main body or be one installed on an image forming apparatus main body. Due to this, it is also possible to control operations of the sheet finisher by a control section that controls the image forming apparatus. Further, an operation section that conducts setting input of the sheet finisher may also be one equipped on the image forming apparatus main body, in addition to one installed on the sheet finisher main body. Owing to this, it becomes possible to input setting relating to the sheet finisher on the image forming apparatus side.

What is claimed is:

1. A sheet finisher comprising:

an adhesive coating section that coats an adhesive on a spine of a sheet bundle, the adhesive coating section comprising (i) an adhesive storing section that stores the adhesive, and (ii) a rotary adhesive supplying section for coating the adhesive, wherein the rotary adhesive supplying section takes the adhesive out from the adhesive storing section by rotating while touching the adhesive stored in the adhesive storing section;

a movement mechanism that moves the adhesive coating section relatively to the spine of the sheet bundle in a longitudinal direction of the spine of the sheet bundle; and a control section that controls actions of the adhesive coating section and the movement mechanism, the control section including a storage section that stores a plurality of different time periods that are based on at least one of a sheet type and a sheet thickness, wherein the control section is operable to control the movement mechanism to move the adhesive coating section reciprocally and relatively with respect to the spine of the sheet bundle to perform multiple adhesive coatings, and is operable to conduct a preparation process that comprises controlling the rotary adhesive supplying section to rotate for a prescribed period of time, which is set by reading one of the time periods from the storage section, while not coating the adhesive on the spine of the sheet bundle, after completion of one of the multiple adhesive coatings and before beginning a next one of the multiple adhesive coatings, wherein in the preparation process the control section controls the rotary adhesive supplying section to rotate in a direction corresponding to a direction in which the adhesive coating section will move in the next one of the multiple adhesive coatings.

2. The sheet finisher of claim 1, wherein the control section controls the movement mechanism not to move the adhesive coating section during the preparation process.

3. The sheet finisher of claim 1, wherein the control section controls a rotation speed of the rotary adhesive supplying section to be higher in the preparation process than in the multiple adhesive coatings.

4. The sheet finisher of claim 1, wherein the control section controls the movement mechanism to move the adhesive coating section in the preparation process, and controls a movement speed of the adhesive coating section to be lower in the preparation process than in the multiple adhesive coatings.

5. The sheet finisher of claim 1, wherein the control section controls the rotary adhesive supplying section to make at least one rotation in the preparation process.

6. The sheet finisher of claim 1, wherein the control section determines whether or not to conduct the preparation process.

7. The sheet finisher of claim 6, wherein the control section determines whether or not to conduct the preparation process in accordance of a sheet type or a thickness of the sheet bundle.

8. The sheet finisher of claim 1, wherein the control section is operable to select whether or not to change the direction in which the rotary adhesive supplying section rotates to correspond to the direction in which the adhesive coating section moves, when the adhesive coating section changes direction during the multiple adhesive coatings.

9. The sheet finisher of claim 1, further comprising an operation section to accept an input from an operator.

10. An image forming system comprising:

an image forming apparatus having an image forming section that forms an image on a sheet; and the sheet finisher of claim 1.

11. The image forming system of claim 10, further comprising an operation section provided on the image forming apparatus main body, to accept an input relating to the sheet finisher from an operator.

* * * * *